US006364128B1

(12) United States Patent
Wohlford

(10) Patent No.: US 6,364,128 B1
(45) Date of Patent: Apr. 2, 2002

(54) WIRE COVER FOR ELECTRONIC EQUIPMENT STAND AND FURNITURE

(75) Inventor: James G. Wohlford, Minneapolis, MN (US)

(73) Assignee: Decade Industries, Inc., Arden Hills, MN (US)

( * ) Notice: Subject to any disclaimer, the term of this patent is extended or adjusted under 35 U.S.C. 154(b) by 0 days.

(21) Appl. No.: 09/705,241

(22) Filed: Nov. 2, 2000

Related U.S. Application Data

(60) Provisional application No. 60/173,668, filed on Dec. 30, 1999.

(51) Int. Cl.[7] ..... A47F 5/00

(52) U.S. Cl. ..... 211/26; 211/182; 361/826; 361/683; 312/223.2

(58) Field of Search ..... 211/183, 189, 211/26; 361/826, 683, 829; 312/223.2, 265.1, 265.2, 265.3, 265.4, 265.5, 265.6

(56) References Cited

U.S. PATENT DOCUMENTS 2,104,376 A * 12/1938 Anderson
3,635,174 A * 1/1972 Ball et al. ..... 312/223.2 X
3,657,608 A * 4/1972 Leone et al.
4,681,378 A * 7/1987 Hellman
4,841,412 A * 6/1989 Heys et al.
4,884,513 A * 12/1989 Newhouse et al.
5,144,896 A * 9/1992 Fortsch
5,277,131 A * 1/1994 Fortsch
5,479,747 A * 1/1996 Wu
5,697,811 A * 12/1997 Pickler et al. ..... 211/26 X
5,832,073 A * 11/1998 Hannigan et al.
5,833,332 A * 11/1998 Marshall et al.
5,901,513 A * 5/1999 Mollenkopf et al.

* cited by examiner

*Primary Examiner*—Robert W. Gibson, Jr.
(74) *Attorney, Agent, or Firm*—Kinney & Lance, P.A.

(57) ABSTRACT

An electrical cord concealment and support system comprising a first slot, a second slot, a cover and a cavity. The cover and the slots are capable of creating a concealment for wire cords of electronic equipment. The cover is aligned with both of the slots and then inserted into the slots. Once the cover is inserted, the cavity is created. The cavity and cover provide a concealment for the cords of electronic equipment placed on the shelves.

20 Claims, 8 Drawing Sheets

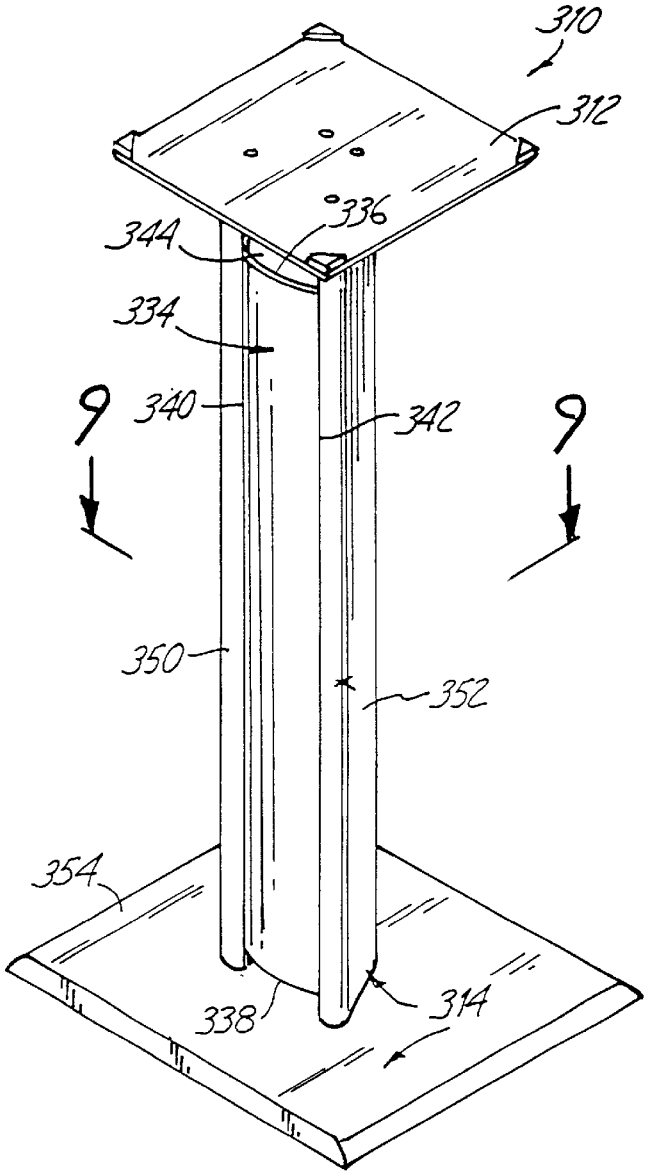
FIG. 8
FIG. 9
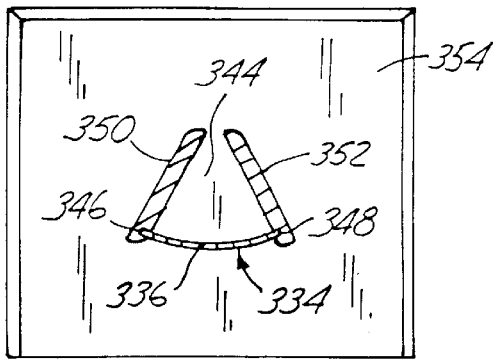

WIRE COVER FOR ELECTRONIC EQUIPMENT STAND AND FURNITURE

CROSS-REFERENCE TO RELATED APPLICATION(S)

This application claims the benefit of the filing date of U.S. Provisional Application Ser. No. 60/173,668 entitled "Electronic Equipment Stand with Wire Cover", which was filed Dec. 30, 1999.

BACKGROUND OF THE INVENTION

The present invention pertains to providing a wire cover for electronic equipment that protects and covers cords, cables or wires that are associated with electronic equipment placed on the shelving system. More particularly, the invention pertains to a wire cover for an electronic equipment stand or other piece of furniture.

Electronic equipment is generally located or placed on some type of shelving system, stand, or desk so that it is at a convenient height to operate and use. Electronic equipment includes items such as stereos, DVD players, compact disc players, speakers, tape decks, receivers, VCRs, televisions, video game players, computers, printers, or monitors. Electronic equipment generally requires either cords, cables, or wires to operate properly. The cords, cables, or wires provide electrical power to the equipment or interconnects one piece of equipment to another. This typically results in the cords, cables, or wires extending out of the back of the shelving system, desk, or stand that the electronic equipment is placed upon.

The shelving system, desk, or stand may be placed along a wall confining the cords between the stand and the wall. Alternatively, the shelving system, desk, or stand may be in a more open area leaving the cords exposed. Either way, the cables or cords can create the potential of a safety hazard for someone to trip over as well as being visually unappealing. Exposed electrical or interconnection wires or cables from electronic equipment can create a safety hazard to adults, infants, and the equipment itself. First, the wires become a hazard to people. Wires extending out from the shelving system are easy to trip over or become intertwined with, resulting in injury to the person. Another safety hazard is that the protruding wires are readily accessible to infants and toddlers, especially when the stand is placed in a more open area where the cords are exposed. The infants or toddlers may bite or pull on the wires resulting in injuries. In this case, the injuries can be very severe such as electric shock, or the child may pull the piece of equipment off of the shelf.

The extruding wires may become intertwined with each other creating a hazard when one or more of the pieces of the electronic equipment are removed from the shelving system. Injury or damage may occur when the wires of a piece of electronic equipment are intertwined with another piece of electronic equipment that is being moved. The intertwined pieces of equipment may be on the same or different shelf or even on different stands at other locations. Moving the piece of electronic equipment may cause the other pieces of equipment to fall and result in injury to the person moving the equipment, a bystander or the equipment itself. Damage to the electronic equipment include bent or broken connection pins or points, loss of equipment function or physical damage.

Whether placed along a wall or in a more open view, an array of wires which typically extend out of and run along the back of the shelving system is not visually appealing. A mass of wires existing behind an otherwise clean, dramatic appearing stand significantly detracts from the appearance of the shelving system.

Various techniques have attempted to address these problems. One technique is to create a wire channel with a boxed profile along a back surface of the shelving system and then place a top across the otherwise open box. The box can either be routed out of the material comprising the back of the shelving system or can be attached to the back of the shelving system. The box can be made out of any suitable material. The top is then placed over the open box to enclose it. This technique, however, is labor intensive and cost prohibitive.

Other techniques such as wire, ties, clips, and Velcro strips have also been used. These techniques, however, do not cover the wires that extend out of the back of the shelving system. Rather, these techniques merely secure the wires in a bundle. The bundle of wires remain exposed resulting in poor aesthetic quality of the shelving system. Also in using these techniques, whenever a person wants to take a part of the electronic system out, the entire bundle of wires must be undone to retrieve the desired piece of equipment from the shelf. Once the equipment is removed, the remaining wires are resecured in a new bundle, This procedure entails a large amount of work and effort, and the end result is a visually unappealing bundle of wires.

Another approach has attempted to use plastic tubing having a circular cylindrical shape to encase the wires extending out of the back of the shelving system. This technique, however, is not visually appealing because the plastic tubing is exposed behind the shelving system and is therefore limited to use with furniture placed along a wall.

A satisfactory technique to cover the wires extending from various pieces of electronic equipment placed on a shelving system that is efficient to manufacture and is reasonably priced is presently not available. The present invention is directed at a shelving system that provides a cover for wires from electronic equipment placed upon it while eliminating safety hazards, maintaining aesthetic quality, and minimizing the effort and cost of construction.

BRIEF SUMMARY OF THE INVENTION

The invention is a device for concealing cables from electronic equipment that is placed on a shelving system. The device comprises a first slot, a second slot and a cover. The first and second slots are either directly cut into the frame of the shelving system or cut into an external member which is then fastened to the frame of the shelving system. The cover has a top, a bottom, and a first and a second side. The first side of the cover is inserted into the first slot and the second side of the cover is inserted into the second slot. Once the cover is inserted into the slots, a cavity is created to contain the cables of the electronic equipment placed on the shelving system. The cover has a width from side to side that is greater than the distance between the first and the second slots causing the cover to bow and create the cavity.

BRIEF DESCRIPTION OF THE DRAWINGS

FIG. 8 is a detailed perspective view from a back side of a third alternate embodiment of the invention.

FIG. 9 is a horizontal sectional view of the third alternate embodiment of the invention taken along a line 9—9 of FIG. 8.

DETAILED DESCRIPTION

Figure 1:
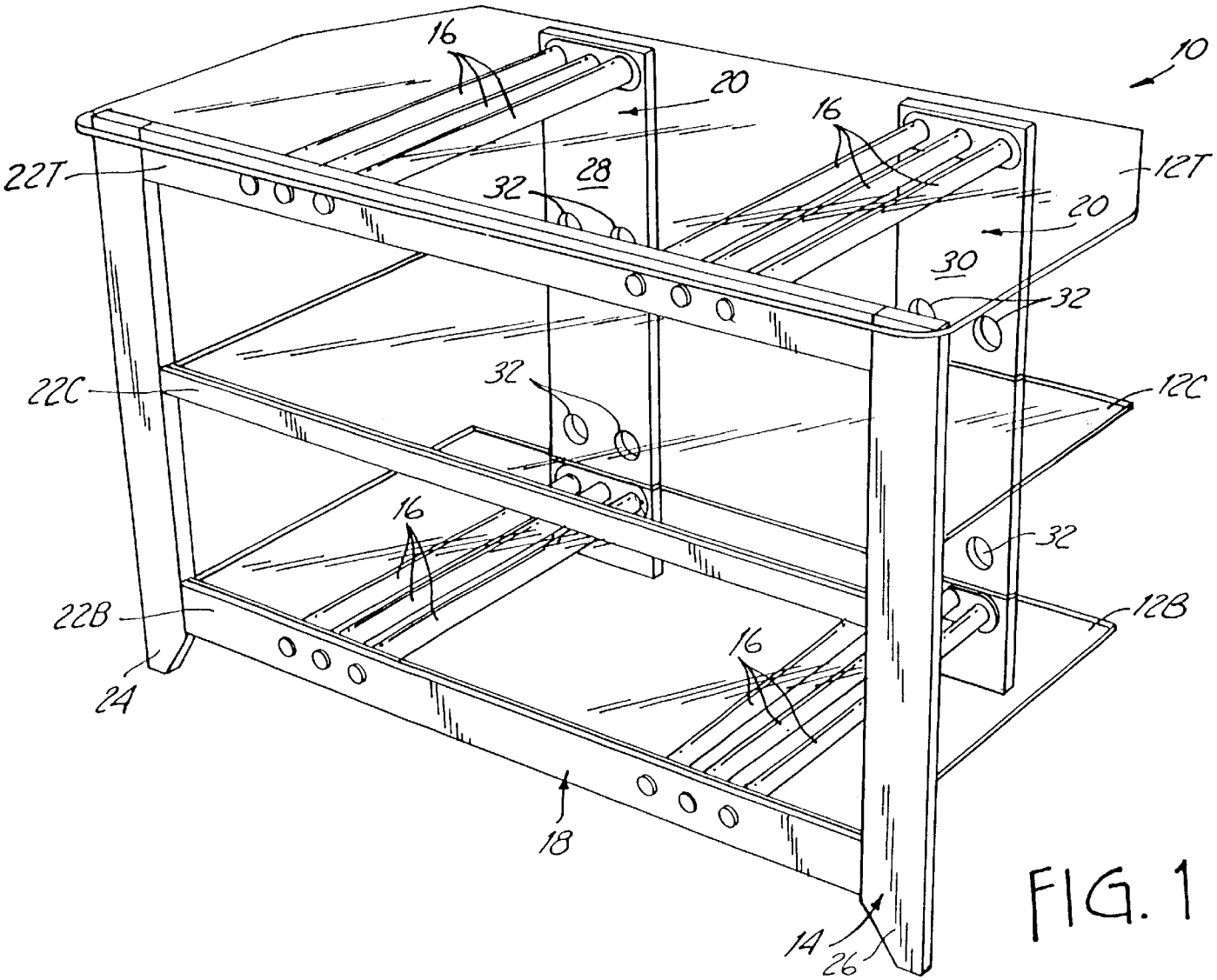
FIG. 1 is a perspective view of a preferred embodiment of a shelving system of the invention.

A preferred embodiment of a shelving system 10 is shown in FIG. 1 The shelving system 10 includes, a top shelf 12T, a center shelf 12C, a bottom shelf 12B, and a frame 14. The shelves 12T, 12C and 12B are supported by the frame 14 and a series of connection bars 16. The frame 14 preferably includes a front support 18 and a back support 20. The connection bars 16 secure the front support 18 and the back support 20 together to create the frame 14.

The front support 18 is comprised of a top cross-support member 22T, a bottom cross-support member 22B, a center cross-support member 22C, a first fore leg 24 and a second fore leg 26. The cross-support members 22B, 22T and 22C are attached to the fore legs 24 and 26 perpendicularly. The back support 20 is comprised of a first rear leg 28 and a second rear leg 30. As shown in FIG. 1, the rear legs 28 and 30 are each attached to the top cross-support member 22T and the bottom cross-support member 22B by the connection bars 16 to form the frame 14 of the shelving system 10 upon which the individual shelves 12T, 12C and 12B can then be supported. The rear legs 28 and 30 attach to the connection bars 16 perpendicularly.

The shelves 12T, 12C and 12B are used to support various pieces of electronic equipment such as televisions, stereos, CD players, DVD players, satellite receivers, speakers or amplifiers. A set of wire holes 32 through the frame 14 allow wire connections to be made between multiple pieces of electronic equipment located on different shelves as well as to provide electrical input to the equipment from an outlet.

Figure 2:
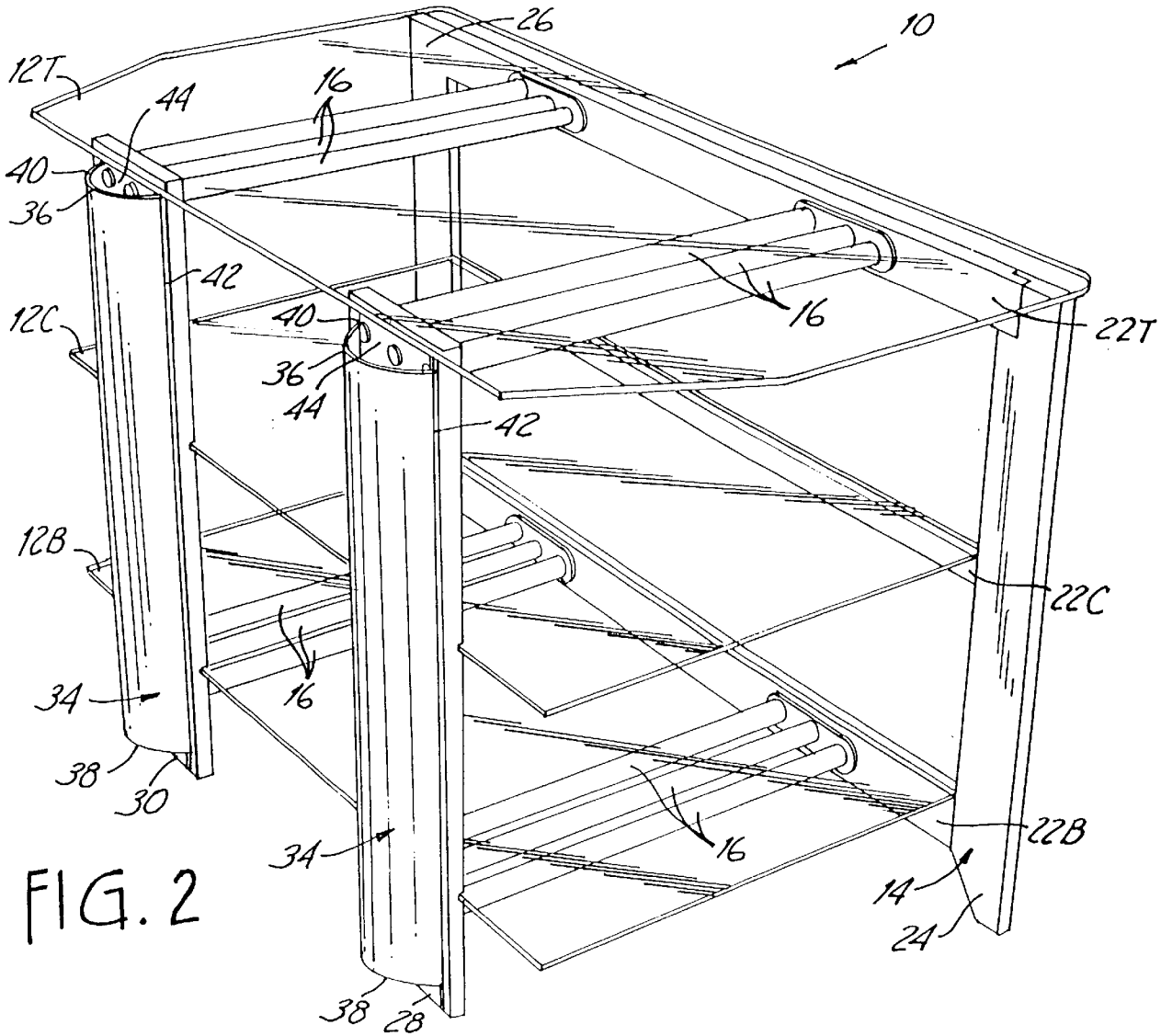
FIG. 2 is a perspective view from a back side of the preferred embodiment of the invention.

FIG. 2 is a perspective view of a back side of the preferred embodiment of the shelving system 10. FIG. 2 allows a more clear view of the back support 20 comprised of the rear legs 28 and 30. In a preferred embodiment, a pair of covers 34 are placed along the back side of the rear legs 28 and 30. The cover 34 has a top 36, a bottom 38, a first side 40 and a second side 42.

In this embodiment of the invention, the covers 34 in conjunction with the rear legs 28 and 30 are used to create a pair of cavities 44. The cavities 44 are used to enclose the cables of the electronic equipment placed on the shelving system 10. The cables would run down the back side of the shelving system 10 within the cavity 44 between the cover 34 and either one of the rear legs 28 and 30 extending down to the floor. Cables may run from one shelf to another in which case the cables would not be visible because the cover 34 would encase the cables entirely. However, the cables may extend to an outlet to provide electric power to the piece of electronic equipment. If the cables do run to an outlet or somewhere other than another shelf of the system 10, such as to a Cable TV jack, a Satellite TV jack, or a telephone jack, it will preferably exit the cavity 44 along the bottom of the cover 34 to minimize safety hazard and maximize appearance.

Figure 3:
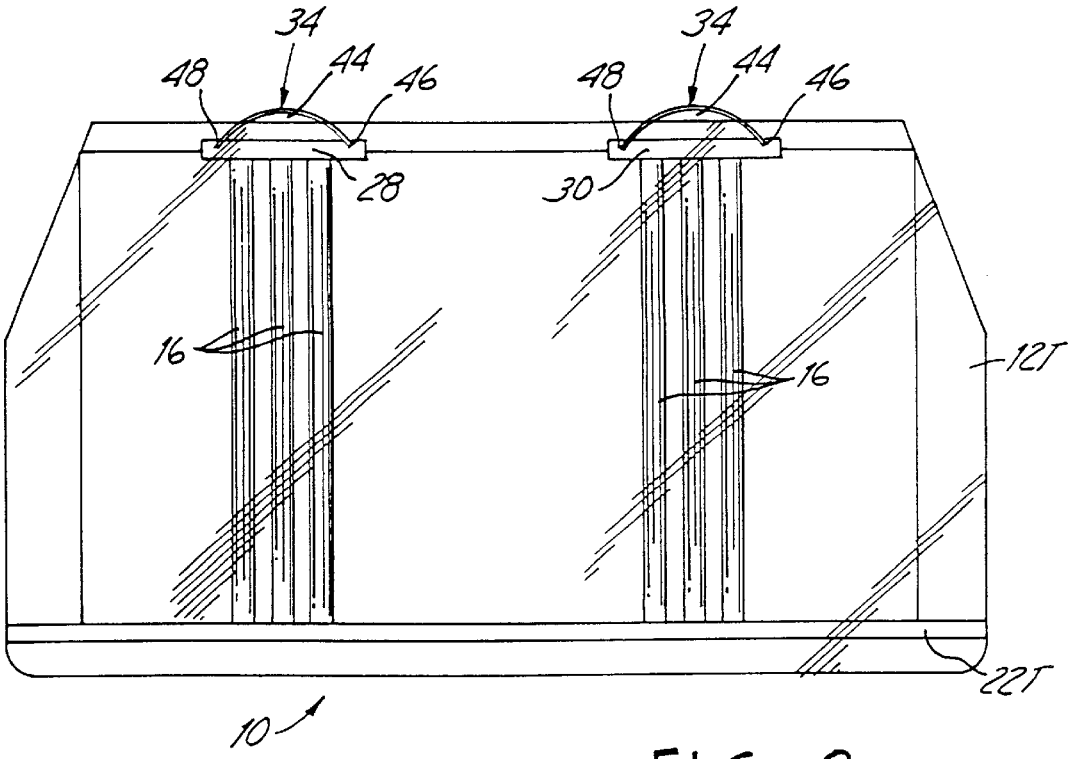
FIG. 3 is a top plan view of a preferred embodiment of the invention.

FIG. 3 is a top plan view of the preferred embodiment of the shelving system 10. FIG. 3 allows a more detailed view of the cover 34 secured to the frame 14 to create the cavity 44. As shown in FIG. 3, the first side 40 of each of the covers 34 is inserted into a first slot 46 and the second side 42 is inserted into a second slot 48 by bending the respective cover 34 causing it to bow outward creating the cavity 44. Once the sides 40 and 42 of the cover 34 are inserted into the first and second slots 46 and 48, the cavity 44 is created by the cover 34 and the respective rear legs either 28 or 30. The cavity 44 contains the cables of the electronic equipment placed on the shelving system 10.

The cover 34 is preferably made of a semi-flexible plastic material, that has a sufficient rigidity to maintain its shape. Also, the color of the cover 34 preferably accents the shelving system 10.

The cover 34 preferably has a length from the top 36 to the bottom 38 that is approximately equal to the length that the slot 46 and the slot 48 extend. This length is preferred because the cables and back of the shelving system 10 would then be concealed from the top to near the bottom by the cover 34.

In order to cause the cover 34 to bow and create the cavity 44, the width of the cover 34 from the side 40 to the side 42 is greater than the width or distance between the slots 46 and 48. The width of the cover 34 will affect the volume of the cavity 44. As the width of the cover 34 is increased, the volume of the cavity 44 gets larger. Therefore, if the electronic equipment has large, thick cables, then the cover 34 should have a width that extends well beyond the distance between the slots 46 and 48. If the equipment has small cables, then the width of the cover 34 only has to be slightly larger than the distance between the slots 46 and 48. This feature allows customization of the size of the cavity 44 which encases the cables of the electronic equipment placed on the shelves if necessary or desired.

Figure 4:
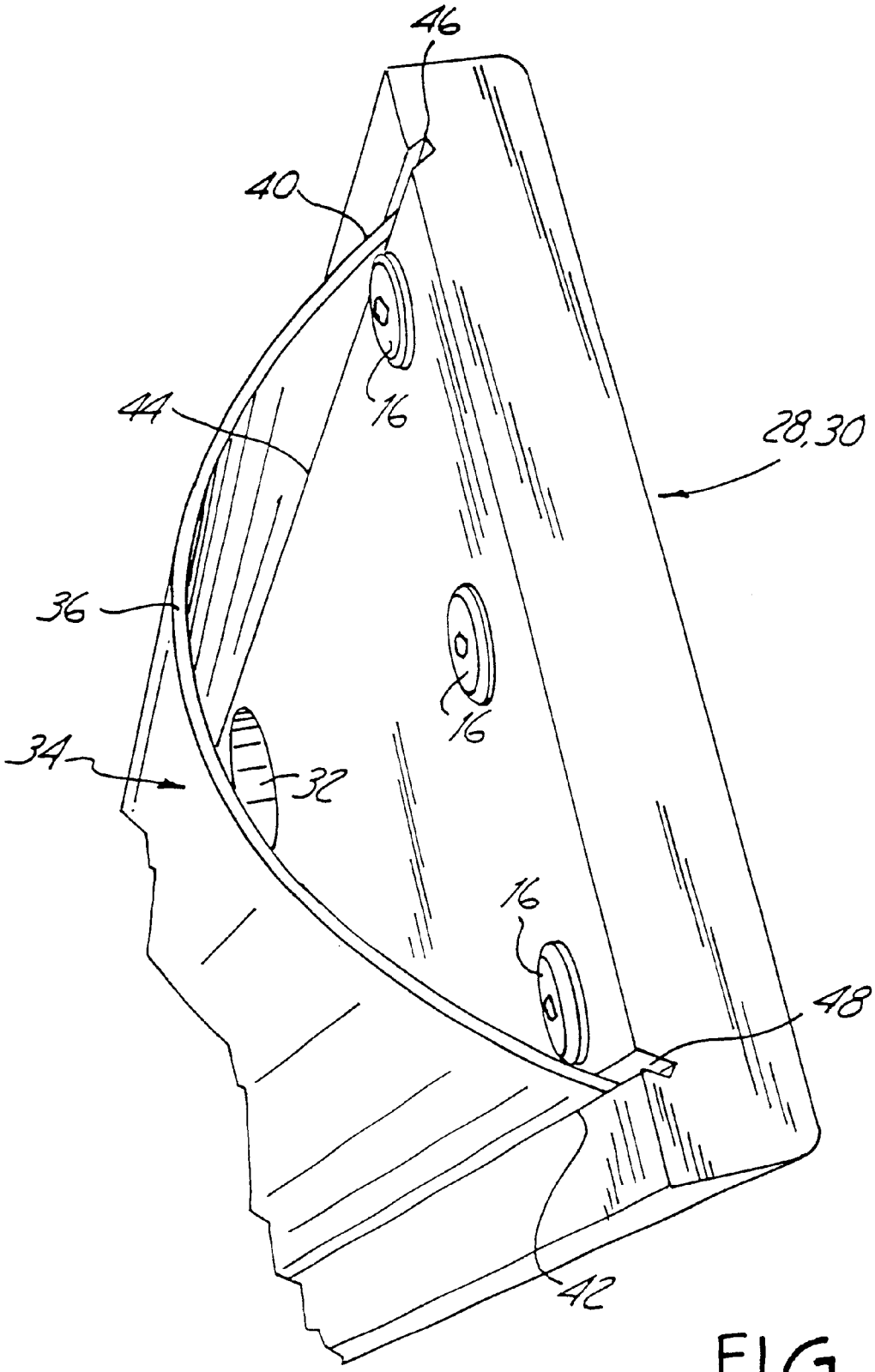
FIG. 4 is a detailed perspective view of a preferred embodiment of the invention.

FIG. 4 is an enlarged view of either the rear leg 28 or the rear leg 30, the cover 34, the inner cavity 44 and the slots 46 and 48. As illustrated in FIG. 4, the cover 34 bows when the sides 40 and 42 are inserted into the slot 46 and the slot 48 creating the cavity 44 with the rear leg 28 or 30. The first slot 46 and the second slot 48 are preferably cut into the frame 14 of the shelving system 10. Cutting the slots 46 and 48 into the frame 14 is visually appealing because there is no extra material appended to the shelving unit. Also, it allows for ease of manufacturing and is more economical because there is not the need to secure extra material to the shelving system 10.

The slots 46 and 48 are preferably cut so that they create one continuous slot along the back side of the frame 14. The continuous formation of the slots 46 and 48 allows for the complete concealment of the electrical cords of the equipment placed on the shelving system 10 from the top to near the bottom of the system 10. Additionally, when the slots 46 and 48 are vertically placed on the shelving system 10, they preferably have a length equal to the height of the frame 14 of the shelving system 10. Complete concealment of the electrical cords occurs because the slots 46 and 48 run along the entire backside of the frame 14, and the cover 34 preferably has a length which is just less than the length that the slots 46 and 48 run to allow the concealed cords to exit from the system 10 out of the bottom or near the floor. In this manner, when the cover 34 is inserted into the continuous slots 46 and 48, the entire backside of the frame is concealed. Also, the continuous formation and the length of the slots 46 and 48 allows for ease of manufacturing because the slots 46 and 48 can be created with one continuous cut, in this case, along the entire length of the rear legs 28 and 30 rather than attempting to cut along intermediate portions of the frame 14 to create the slots 46 and 48.

Further, slot 46 and slot 48 preferably are cut into the frame at an angle in relation to each other. Placing the slots 46 and 48 at an angle causes a larger surface area of the cover 34 to make contact with the slots 46 and 48. A larger surface area contact is created because the angled positioning of the slots 46 and 48 causes the cover 34 to bend at the first side 40 and the second side 42 at approximately the same angle degree the slots 46 and 48 are positioned. This bending forces a larger surface of the cover 34 to make contact with the slots 46 and 48. The larger surface contact of the cover 34 on the slots 46 and 48 causes the cover 34 to sit in the slots with more stability.

Figure 5:
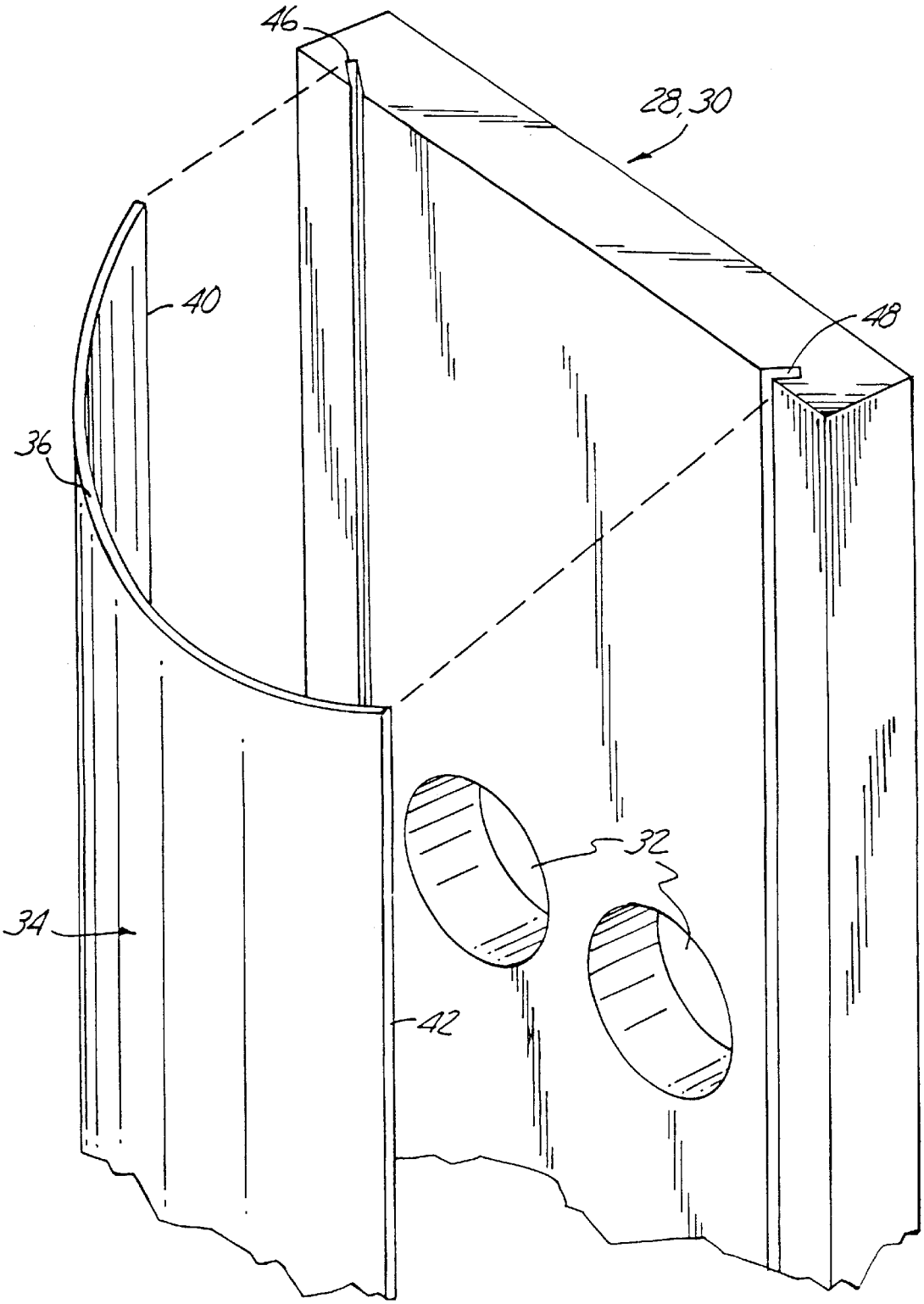
FIG. 5 is an exploded view of a preferred embodiment of the invention.

FIG. 5 is an exploded view of the preferred embodiment of the invention. FIG. 5 shows a more detailed view of the cover 34 and the slots 46 and 48. FIG. 5 illustrates how the cover 34 functions in relation to the slot 46 and the slot 48. As shown in FIG. 5, the cover 34 is comprised of the top 36, the first side 40 and the second side 42. When securing the cover 34 to the frame 14, the first side 40 is aligned with the first slot 46. Once the first side 40 and the first slot 46 are aligned, the first side 40 is inserted into the first slot 46. Once the first side 40 is secured in the first slot 46, the cover 34 is bowed so that the second side 42 is aligned with the second slot 48. Once the second side 42 and the second slot 48 are aligned, the second side 42 is inserted into the second slot 48 creating the cavity 44.

The first slot 46 and the second slot 48 preferably have a depth sufficient to secure the first side 40 and the second side 42 in order to achieve the bowing effect that creates the cavity 44. This depth may range from approximately ¼ inch to 1 inch or more.

The slot 46 and the slot 48 are preferably placed equidistantly apart from each other. Placing the slots 46 and 48 equidistantly apart from each other, allows for ease of inserting the cover 34 and maintains a visually appealing appearance.

Once the cover 34 is completely inserted into the slots 46 and 48, the slots 46 and 48 create a force on the cover 34. The force on the cover 34 is substantially applied to the outside surface of the cover 34 opposite the cavity 44 at the first side 40 and the second side 42. The force causes the cover 34 to bow out creating the cavity 44. The force also ensures that the cover 34 sits securely in the slots 46 and 48. The cavity 44 then contains the electronic equipment cords which are concealed from view by the cover 34.

Although the present invention has been described with reference to the preferred embodiment, changes may be made in form and detail. First, the shelving system 10 could include more or fewer shelves than those depicted in FIG. 1.

Second, while the frame 14 in FIG. 1 has been shown with both the front and back supports 18 and 20, respectively, connected together by the connection bars 16, the frame 14 could also be comprised of more or fewer support members so long as it is capable of supporting the shelf or shelves of the system 10.

Third, while the pair of covers 34 are shown vertically in FIG. 2, they could also be positioned horizontally, diagonally or some combination depending upon the application or appearance desired. A horizontal placement of the covers 34 would be useful when applying them to either computer or office desks which are typically placed in the center or a more open part of the room rather than along a wall. The horizontal position allows the electrical cords to be encased along the frame which is visually appealing and allows easy access to the wires. Alternatively, the covers 34 could also be placed along the front or along the sides of the shelving system 10. For instance, with a desk that has drawers along the back it may be more desirable to place the cover across the front of the desk to contain the cables and cords of a computer that is placed on the top of the desk. The versatile positioning of the cover 34 allows a person to select from many different designs of shelving systems and to arrange the shelving system in a desirable fashion.

Fourth, while the back support 20 in FIG. 2 shows two covers 34, more or fewer covers 34 can also be used.

Fifth, the cover 34 could also be made of wood, metal, or other material so long as it can maintain its general form but has sufficient flexibility to bow when inserted into the slots 46 and 48 to create the cavity 44.

Sixth, the cover 34 could be any color and could also have a design or pattern placed upon it to achieve a desired decorative style.

Seventh, although not as visually appealing, the cover 34 could have a length that is shorter than the length that the slots 46 and 48 extend. This is not as visually appealing because the whole back of the shelving system 10 is not covered possibly exposing portions of the cables, the slots 46 or 48, or the back of the system 10.

Eighth, the slots 46 and 48 could be created by cutting the slots 46 and 48 into an external member that is then secured to the frame 14 of the shelving system 10 or by attaching a pair of strips of material along the frame 14 to create a raised lip or stop to function as the slot and secure the sides 40 and 42. The number of external members depends upon how many covers are needed to cover the wires. The external members containing or creating the slots 46 and 48 could be secured to the frame 14 by using any type of fastening means such as glue, screws, nails or Velcro. Cutting the slot 46 and the slot 48 into an external member allows a person to remove the cover 34 and the slots 46 and 48 from the frame 14 if desired to do so. Removal of the cover 34 and the slots 46 and 48 maybe desired when the shelving system 10 is no longer used to support electronic equipment, but rather used for some other purpose.

Ninth, the length of the slots 46 and 48 can be less than the height of the frame 14 so long as the cover 34 fits into the slots 46 and 48.

Tenth, the slots 46 and 48 do not have to be placed at angles. The cover 34 can be inserted into non-angled slots, though the cover 34 may snap out of the slots 46 and 48 at undesired times due to the minimal contact between the cover 34 and the slots 46 and 48.

Eleventh, the slots 46 and 48 maybe positioned in any desired way as long as the cover 34 fits into the slots 46 and 48. An alternative position may include placing the slots 46 and 48 in a V-shape.

Figure 6:
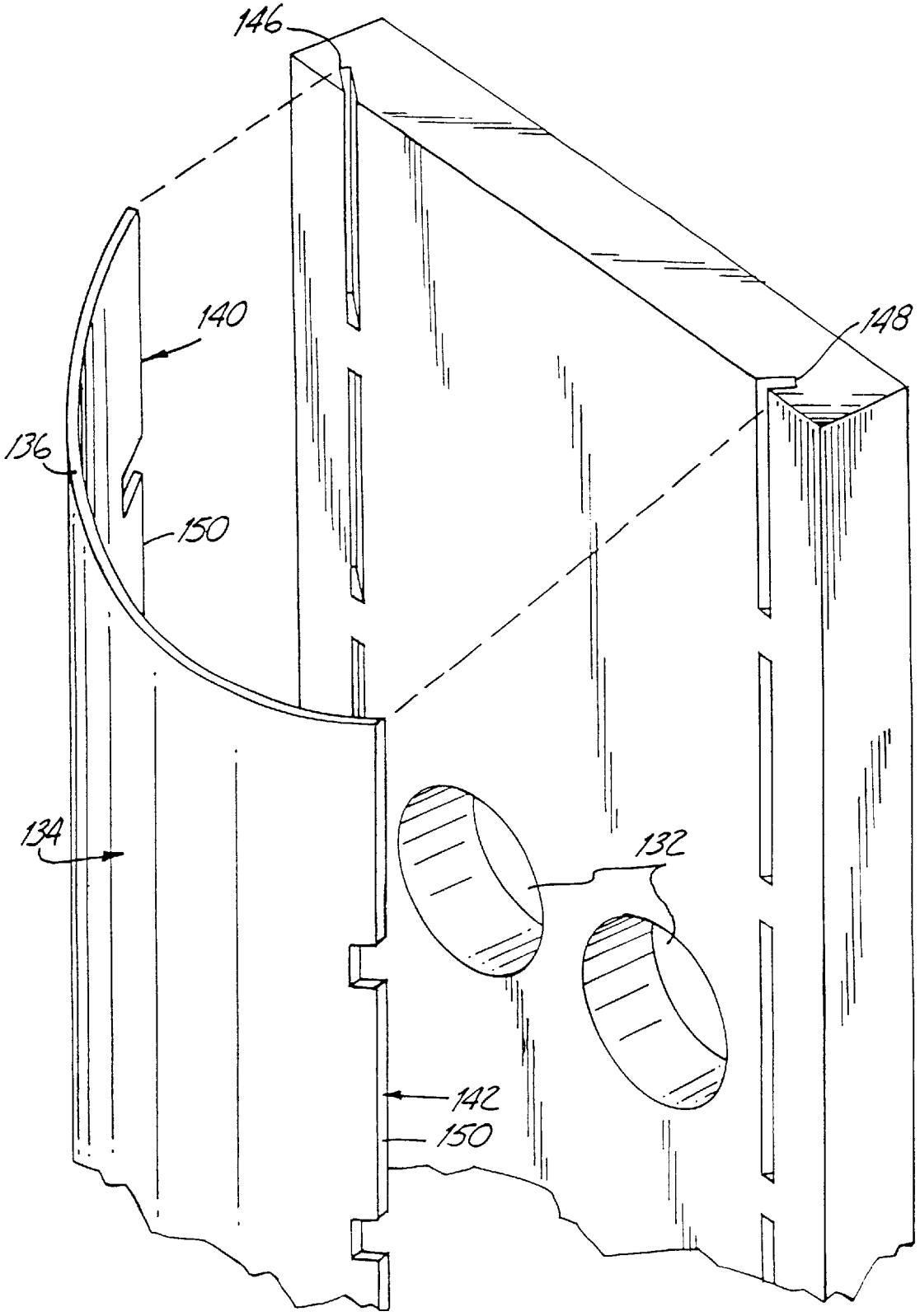
FIG. 6 is a detailed exploded perspective view of a first alternate embodiment of the invention.

FIG. 6 is a detailed exploded perspective view of an alternate embodiment of the shelving system 10. FIG. 6 shows a detailed illustration of an alternative cover 134 and a pair slots 146 and 148. The cover 134 comprises a top 136, a bottom 138, a first side 140, a second side 142 and a set of tabs 150. The set of tabs 150 are located on the first side 140 and on the second side 142. A set of wire holes 132 through the frame allow wire connections to be made between pieces of electronic equipment as well as to provide electrical input to the equipment from an outlet.

Although FIG. 6 illustrates the slots 146 and 148 cut into the frame intermittently, the first slot 146 and the second slot 148 can be cut either into the frame or an external member so that they run continuously or intermittently along the desired path. The set of tabs 150 located on the first side 140 are inserted into the first slot 146 while the set of tabs 150 located on the second side 142 are inserted into the second slot 148 creating a cavity for the wire cables of the electronic equipment to lie.

An intermittent configuration of the slots 146 and 148, however, increases the difficulty of manufacturing because in order to create the intermittent slots the manufacturer must constantly stop and start the cutting process increasing the work effort. Also, the manufacturer must make a cover that contains tabs on the sides that fit into the intermittent slots which also increases the work effort and hence the cost of manufacturing.

Figure 7:
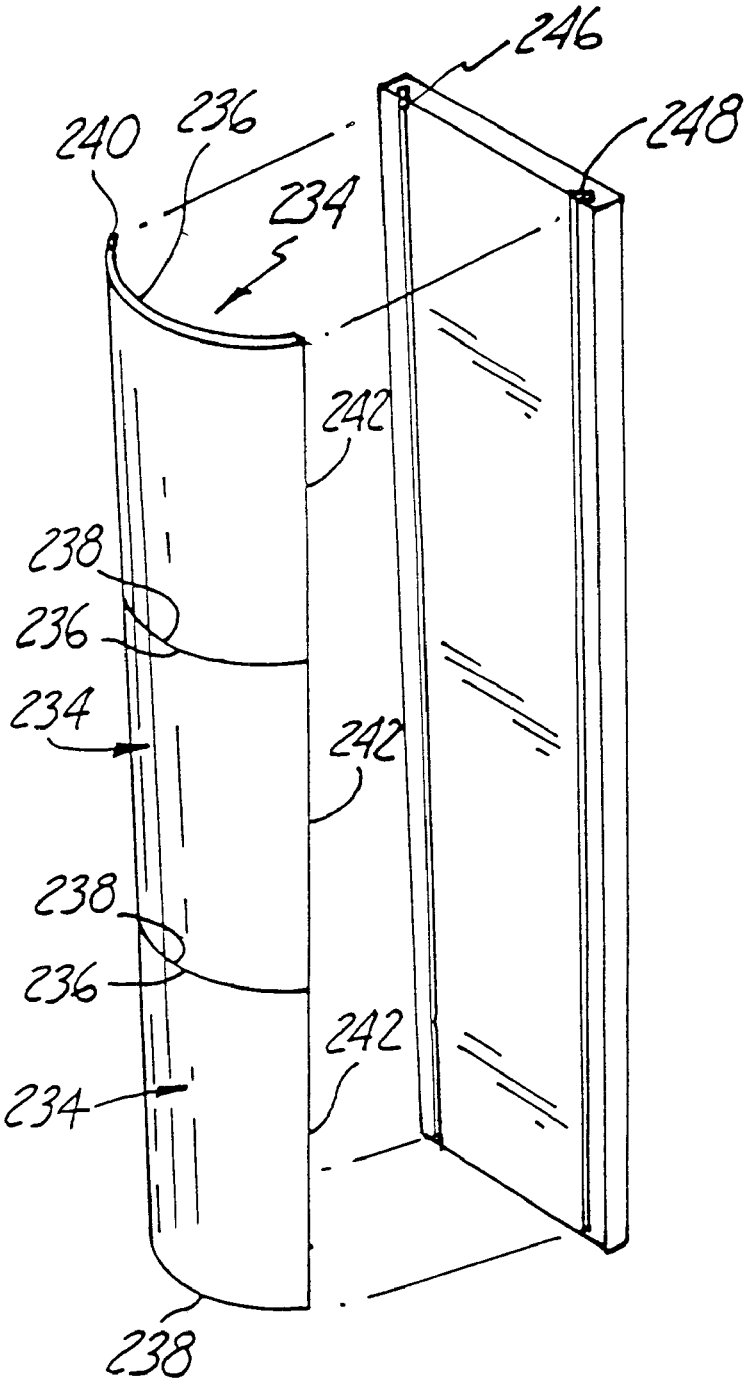
FIG. 7 is a detailed exploded perspective view of a second alternate embodiment of the invention.

FIG. 7 is a detailed exploded perspective view of a second alternate embodiment of the shelving system 10. FIG. 7 shows a detailed illustration of an alternative cover 234 and a pair of slots 246 and 248. The cover 234 is comprised of a top 236, a bottom 238, a first side 240 and a second side 242. The cover 234, in this embodiment, is sectioned into small segments thereby requiring multiple covers 234 to cover the entire length of the slots 246 and 248. The sectioned cover 234 may cover one piece of the frame 14 to another piece of the frame. The sectioned cover 234 may also span the length of the frame 14 concealing the entire back of the shelving system 10. The slots 246 and 248 are again cut either into the frame or created by an external member so that they run either continuously or intermittently along the back of the frame 14.

If the slots 246 and 248 are placed intermittently then they must be placed to ensure that each of the covers 234 has a pair of corresponding slots 246 and 248. Use of the sectioned cover 234 permits a person to easily access the wires of the electronic equipment on a shelf by shelf basis which may be desired. Additionally, the sectioned cover 234 allows a user to cover and conceal only those shelves and wires desired while leaving open other shelves. However, the cost of manufacturing increases because the cover 234 must be cut into smaller sections.

FIG. 8 is a perspective view from the back side of a alternate embodiment of the shelving system 10. FIG. 8 illustrates an alternative shelving system 310. The shelving system 310 is comprised of a shelf 312 supported by a frame 314. As depicted in FIG. 8, the frame 314 includes a left column 350, a right column 352 and a base 354. The left column 350 and the right column 352 are attached to the base 354 perpendicularly. In addition, the shelf 312 is fastened perpendicularly to the top of the left and right columns 350 and 352.

As illustrated in FIG. 8, a cover 334 is placed along the back side of the frame 314. The cover 334 has a top 336, a bottom 338, a first side 340 and a second side 342. In this embodiment, the cover 334 in combination with the columns 350 and 352 are used to create a cavity 344. The cavity 344 is used to enclose the cables of the electronic equipment.

FIG. 9 is a horizontal sectional view taken along a line 9—9 of FIG. 8. FIG. 9 allows a more detailed view of the cover 334 secured to the frame 314 to create the cavity 344. As shown in FIG. 9, the first side 340 of the cover 334 is inserted into a first slot 346 and the second side 342 is inserted into a second slot 348 by bending the cover 334 causing it to bow outward creating the cavity 344. The slots 346 and 348 can be cut into the frame 314 continuously or intermittently. The slots 346 and 348 can also be cut into an external member that is then secured to the frame 314.

This alternate embodiment is desirable when a person wants to shelf a single item or multiple small items. For example, this embodiment could be used to shelve a stereo speaker. Moreover, this embodiment neither increases the amount of work effort nor increases the cost of manufacturing.

Although the present invention has been described with reference to preferred embodiments, workers skilled in the art will recognize that changes may be made in form and detail without departing from the spirit and scope of the invention. For example, the material used to construct the cover and slots may be altered. Further, while the shape of the cover has been shown as cylindrical in the preferred embodiments, other shapes could be used to design the cover. The number of wires, slots, shelves and manner in which the frame is constructed could also be varied. Thus, the shelving system provides improved concealment of electrical cords for electronic equipment placed on the shelving system.

What is claimed is:

1. A shelving system for concealing cables from equipment on a shelf that is supported by a frame, the system comprising:

a first slot placed along one side of the frame;

a second slot placed along the same side of the frame; and a cover having a top, a bottom, a first and a second side, and a width from side to side that is greater than a distance between the first slot and the second slot, wherein the first side is inserted into the first slot and the second side is inserted into the second slot to create a cavity from the top to the bottom of the cover which contains the cables.

2. The system of claim 1, wherein the first slot and the second slot are angled.

3. The system of claim 1, wherein the first slot and the second slot are continuous.

4. The system of claim 1, wherein the first slot and the second slot are intermittent.

5. The system of claim 1, wherein the cover from top to bottom has a length that is equal to a length the slots extend.

6. The system of claim 1, wherein the cover from side to side has a width that is greater than a distance between the slots causing the cover to bow.

7. The system of claim 1, wherein the slots are created by a member affixed to the frame.

8. The system of claim 1, wherein the slots are routed into the frame.

9. The system of claim 1, wherein the slots exist along a back surface of the frame.

10. The system of claim 1, wherein the cover is a plastic material.

11. The system of claim 1, wherein the cover has a color that accents the shelving system.

12. The system of claim 1, wherein a wire hole is placed through the frame in relation to the cover and the slots.

13. A shelving unit comprising:

a frame;

a shelf; and a shelving system for supporting the shelf relative to the frame, the system comprising:

a first angled slot created along one side of the frame;

a second angled slot created along the same side of the frame and which is substantially parallel to the first angled slot; and a cover having a top, a bottom, a first and second side, and a width from side to side that is greater than a distance between the first slot and the second slot, wherein the first side is inserted into the first angled slot and the second side is inserted into the second angled slot to create a cavity to contain the cables.

14. The system of claim 13, wherein the angled slots have a depth sufficient to secure the sides of the cover therein causing force on the cover resulting in the cover bowing out to create the cavity.

15. The system of claim 13, wherein the angled slots are located along a back surface of the frame.

16. The system of claim 13, wherein a wire hole is placed through the frame in relation to the cover and the slots.

17. A shelving system for concealing cables from equipment on a shelf that is supported by a frame, the system comprising:

a first slot placed along one side of the frame;

a second slot substantially parallel to the first slot;

a cover having a top, a bottom, a first and second side, and a width from side to side that is greater than a distance between the first slot and the second slot, wherein the first side is inserted into the first slot and the second side is inserted into the second slot such that force is applied by the slots to the first side and the second side of the cover causing the cover to bow and create a cavity for the cables to lie.

18. The system of claim 17, wherein the first slot and the second slot are angled.

19. The system of claim 17, wherein a wire hole is placed through the frame in relation to the cover and the slots.

20. The system of claim 17, wherein the slots exist along aback surface of the frame.

* * * * *

UNITED STATES PATENT AND TRADEMARK OFFICE

CERTIFICATE OF CORRECTION

PATENT NO. : 6,364,128 B1
DATED : April 2, 2002
INVENTOR(S) : James G. Wohlford

It is certified that error appears in the above-identified patent and that said Letters Patent is hereby corrected as shown below:

Title page,
Under References Cited, U.S. PATENT DOCUMENTS, delete "Pickler et al.", insert -- Pickles et al. --
Item [74], delete "Lance", insert -- Lange --

Column 6,
Line 11, delete "maybe", insert -- may be --
Line 40, delete "maybe", insert -- may be --

Column 10,
Line 14, delete "aback", insert -- a back --

Signed and Sealed this

Eighteenth Day of June, 2002

*Attest:*

*Attesting Officer*

JAMES E. ROGAN
*Director of the United States Patent and Trademark Office*